US005759057A

United States Patent [19]

Cheng et al.

[11] Patent Number: 5,759,057

[45] Date of Patent: Jun. 2, 1998

[54] CONNECTOR WITH HYBRID LATCH DEVICE

[75] Inventors: Lee-Ming Cheng, Cupertino; Edmond Choy, Union City, both of Calif.

[73] Assignee: Hon Hai Precision Ind. Co., Ltd., Taiwan, Japan

[21] Appl. No.: 627,143

[22] Filed: Apr. 3, 1996

[51] Int. Cl.[6] ..... H01R 13/00

[52] U.S. Cl. ..... 439/328; 439/325

[58] Field of Search ..... 439/152–160, 439/326–329, 631–637

[56] References Cited

U.S. PATENT DOCUMENTS

| | | | |
|---|---|---|---|
| 4,995,825 | 2/1991 | Korsunsky et al. | 439/328 |
| 5,112,242 | 5/1992 | Choy et al. | 439/328 |
| 5,203,714 | 4/1993 | Tuan | 439/326 |
| 5,242,312 | 9/1993 | Tondreault | 439/328 |

*Primary Examiner*—Hien Vu

[57] ABSTRACT

A socket (10) for retainably receiving a module (11) therein, includes an insulative housing (12) having a plurality of passageways (16) extending therethrough in a front-to-end direction for receiving a corresponding number of contacts (18) therein for engagement with the corresponding circuit pads on the module. A latch device (26) is positioned at either end of the housing (12) wherein each latch device (26) includes a plastic member (28) integral with housing (12) and an attachable separate metal member (30) wherein the plastic member (28) comprises a resilient main body (48) with an upward extending post (50) proximate the distal end having an expansion head (52) on the tip, and the metal member (30) comprises a resilient main body (54) with a mounting section (58) and a clamping section (60) opposite to the mounting section (58), and an operation section (70) integrally extending from the clamping section (60), whereby by laterally pressing the operation section (70), the plastic member (28) can be actuated to be outward deflected by the outward moving clamping section (60) so that the module (11) can be disengaged from the locking expansion head (52) of the plastic member (28).

11 Claims, 12 Drawing Sheets

CONNECTOR WITH HYBRID LATCH DEVICE

BACKGROUND OF THE INVENTION

1. Field of the Invention

The invention relates to the electrical connector for receiving the module therein, and particularly to the connector having latch devices on two sides for releasably latching the module therein.

2. The Prior Art

SIMM (Single In-Line Memory Module) is popularly used in the computer field. Correspondingly, the SIMM sockets are also popularly used to be mounted on the mother board for receiving such SIMMs therein. To achieve ZIF (Zero Insertion Force) during mating of the module with the socket, the module is generally inserted into the socket at the first position without interference with the contacts in the socket, and later is rotated to the second position for engagement with the corresponding contacts in the socket. Thus, latch devices are required to lock the module in the second position with regard to the socket for preventing the module from being disengaged from the socket. The latch device can be made, integral with the socket housing, by plastics as shown in U.S. Pat. No. 5,267,872, or separable from the housing by metal as shown in U.S. Pat. No. 5,286,217. Because the plastic latch and the metal latch respectively have their own advantages and disadvantages, U.S. Pat. No. 5,203,714 discloses a hybrid type latch device composed of a plastic member and a metal member.

On the other hand, recently there is another type Mini SIMM (or called SO DIMM which is substantially much smaller than the conventional SIMM ) introduced to the computer field, particularly for the notebook computer, and therefore, the corresponding socket, which generally lies on the mother board instead of the conventional SIMM socket standing on the mother board, is also presented to accommodate such Mini SIMM, for example, U.S. Pat. Nos. 5,437,560 and 5,484,302, wherein the former uses plastic latches and the latter uses metal latches for retaining the corresponding modules therein.

An object of the invention is to provide a Mini SIMM socket for retaining the corresponding Mini SIMM therein by the latch device composed of a plastic member integral with the housing and a metal member attachably independent from the housing of the socket whereby it is easy to fabricate and successively assemble the whole socket with the integral plastic member and the independent and separate metal member.

Another object of the invention is to provide a Mini SIMM socket having a latch device composed of a plastic member and a metal member wherein the metal member can efficiently actuate the plastic member so that the latch device can easily and reliably latch or release the corresponding module onto or from the socket.

SUMMARY OF THE INVENTION

According to an aspect of the invention, a socket for retainably receiving a module therein, includes an insulative housing having a plurality of passageways extending therethrough in a front-to-end direction for receiving a corresponding number of contacts therein for engagement with the corresponding circuit pads on the module. A latch device is positioned at either end of the housing wherein each latch device includes a plastic member integral with housing and an attachable separate metal member wherein the plastic member comprises a resilient main body with an upward extending post proximate the front end having an expansion head on the tip, and the metal member comprises a resilient main body with a mounting section, a clamping section opposite to the mounting section, and an operation section integrally extending lengthwise outward from the clamping section, whereby by laterally pressing the operation section, the plastic member can be actuated to be outward deflected by the outwardly moving clamping section so that the module can be disengaged from the locking expansion head of the plastic member.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
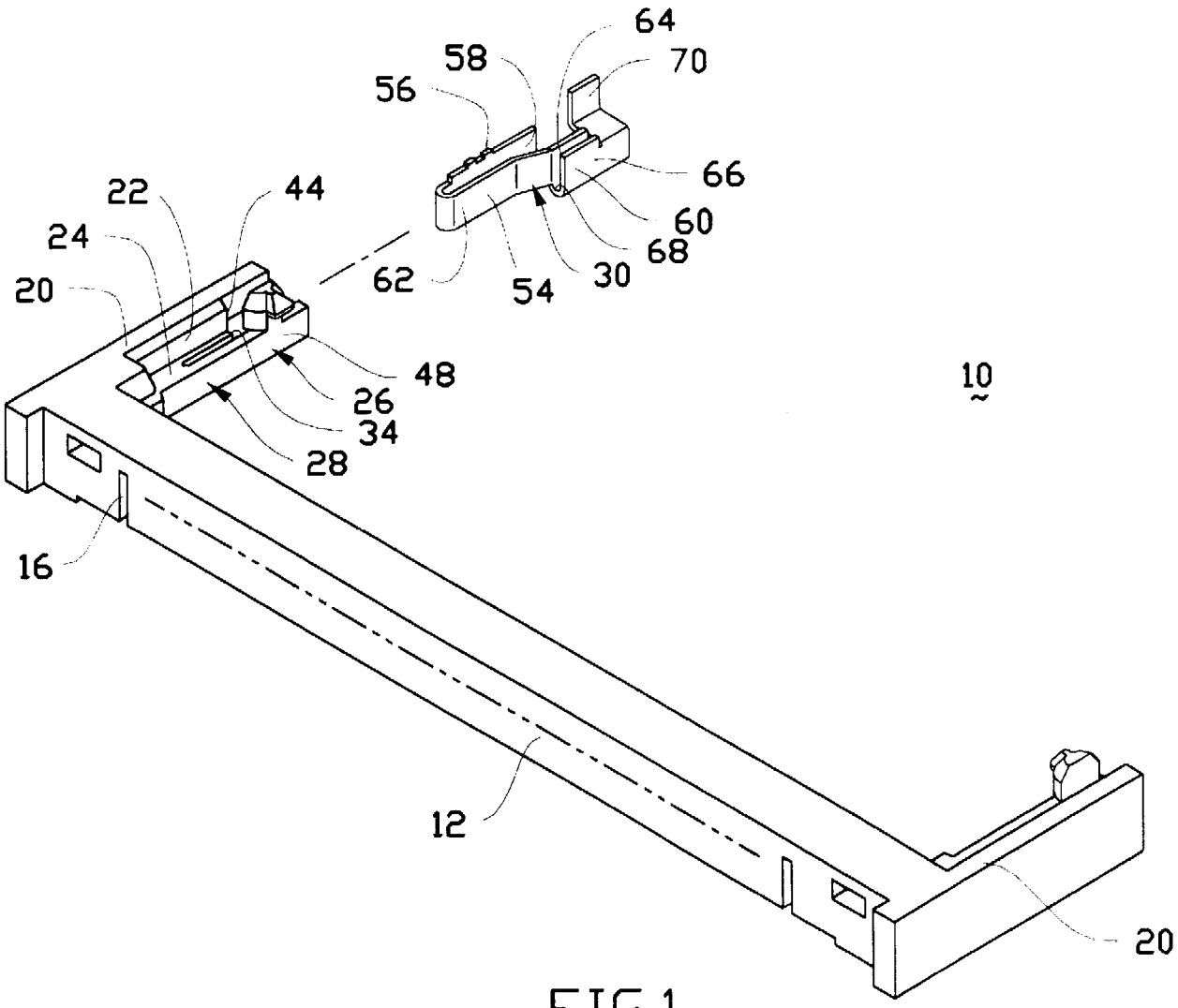
FIG. 1 is a perspective view of a presently preferred embodiment of a socket without contacts therein according to the invention wherein the metal member is detached from the housing (only one metal member is shown).
Figure 1A:
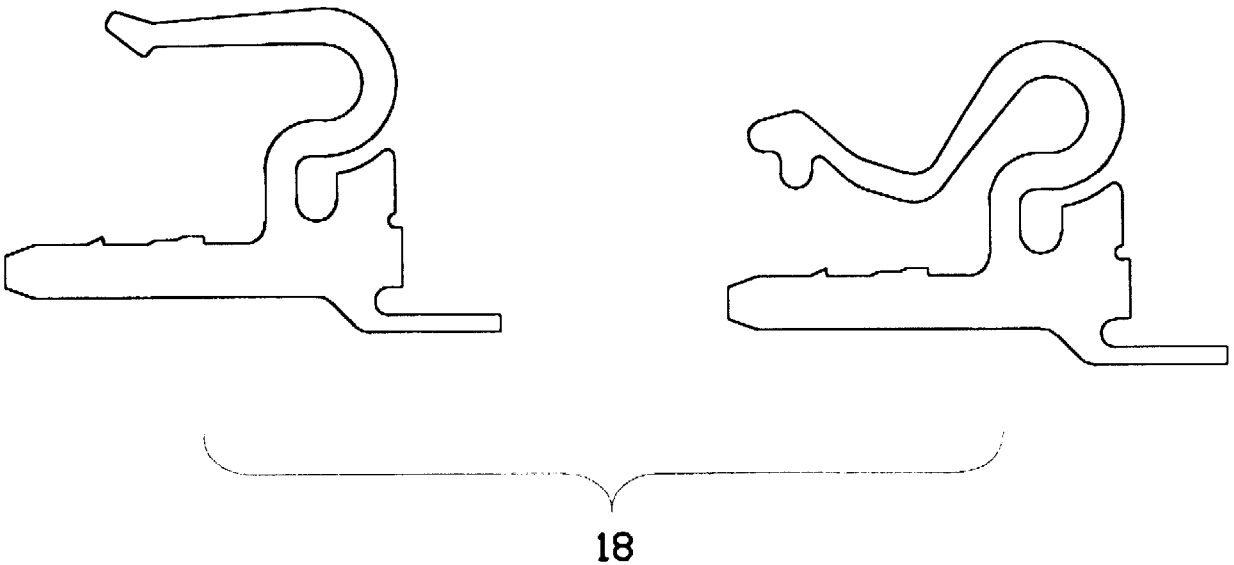
FIG. 1(A) is a plan view of two-type contacts for use within the socket of FIG. 1.
Figure 2:
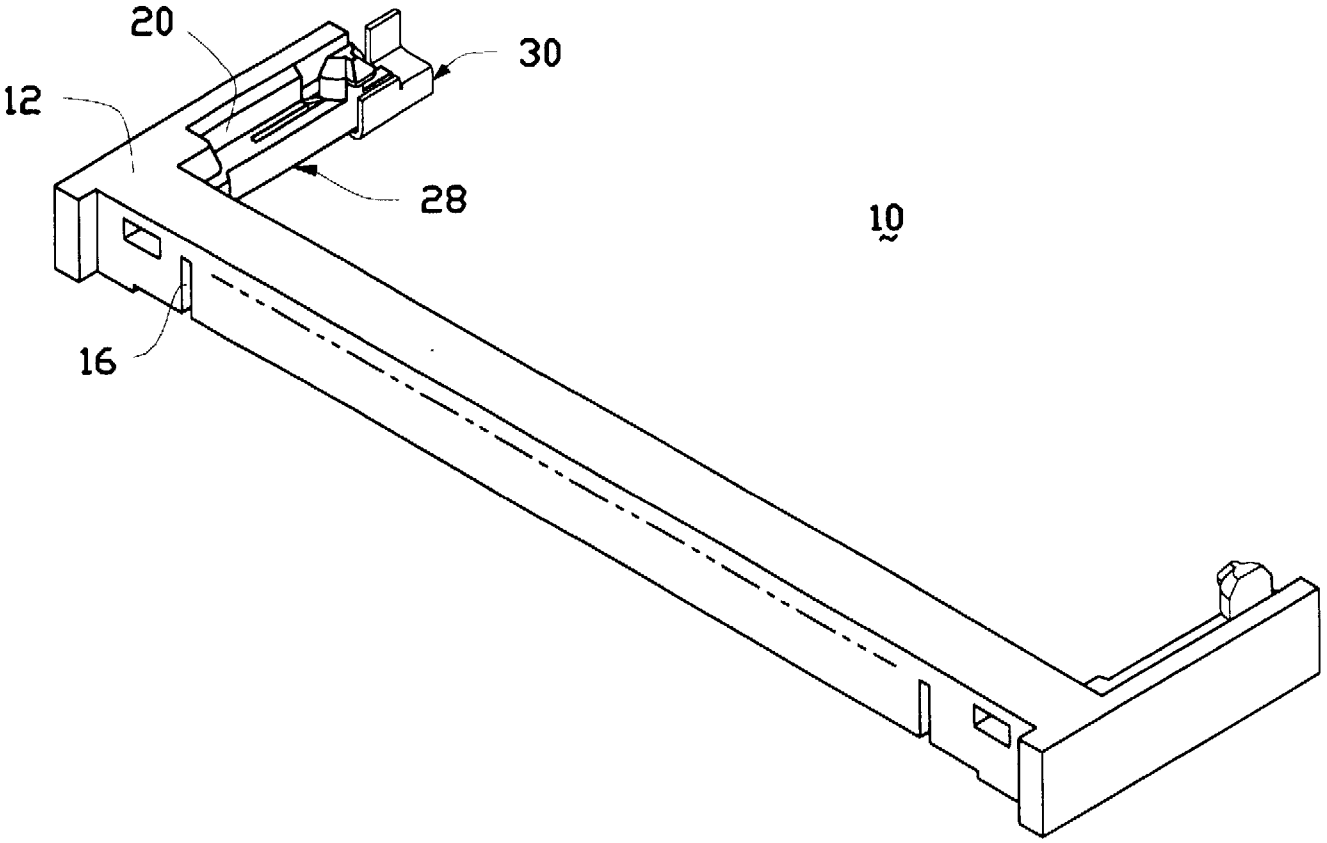
FIG. 2 is a perspective view of the assembled socket of FIG. 1.
Figure 2A:
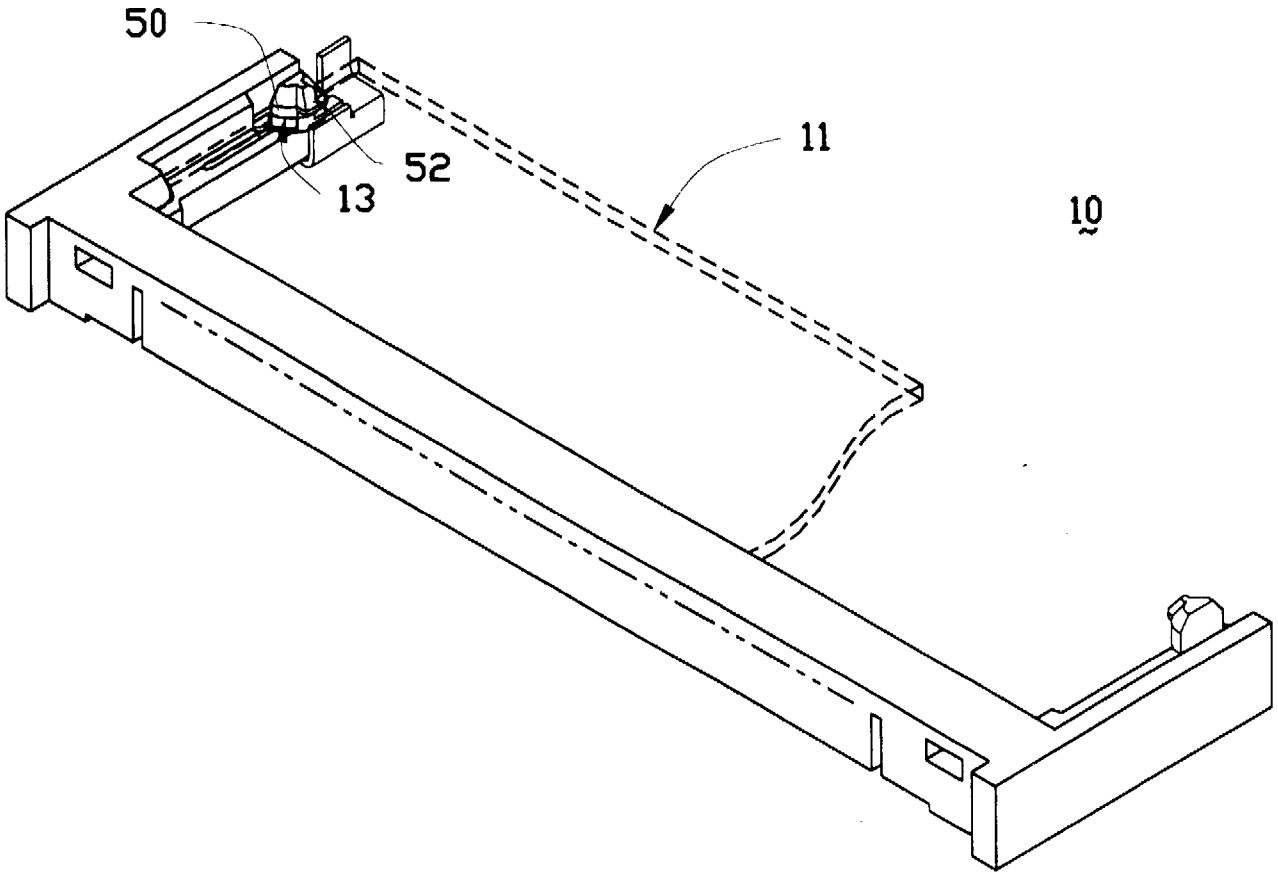
FIG. 2(A) is a perspective view of the assembled socket of FIG. 1 wherein a fragmentary module is shown by dashed lines for illustrating relationship between the module and the plastic member.
Figure 3:
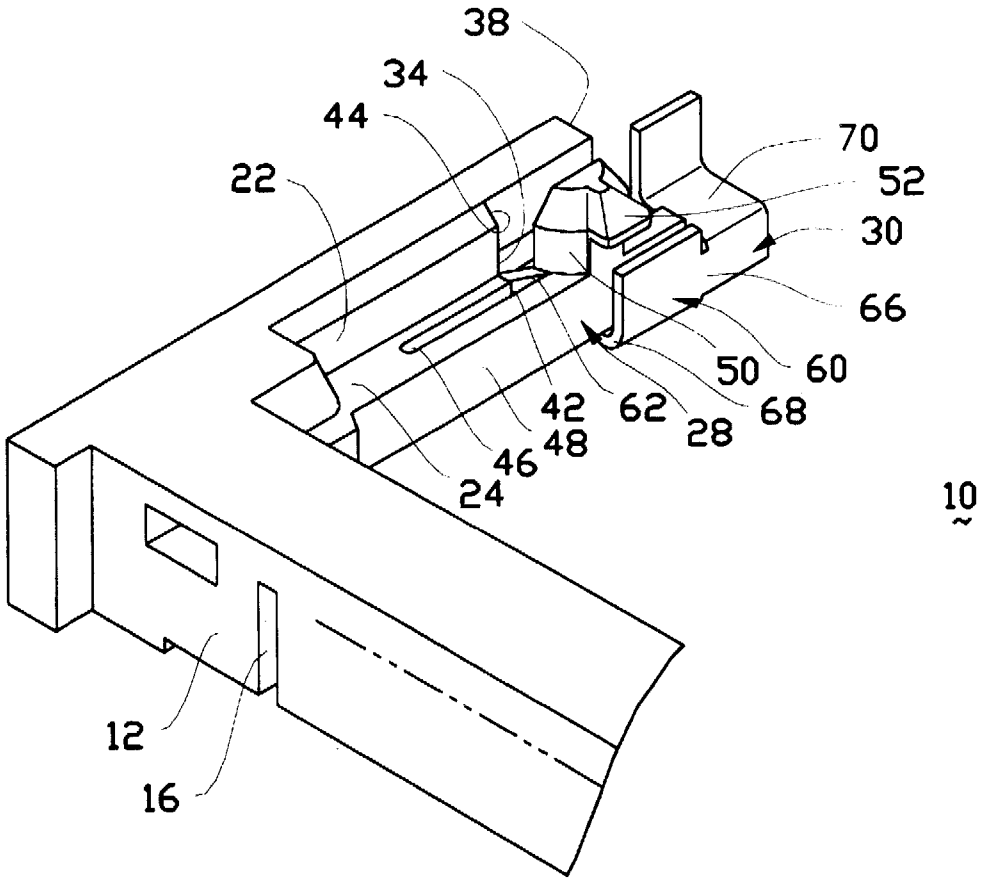
FIG. 3 is an enlarged fragmentary perspective view of the socket of FIG. 1 with the metal member therein to show the relationship between the metal member and the plastic member.
Figure 4:
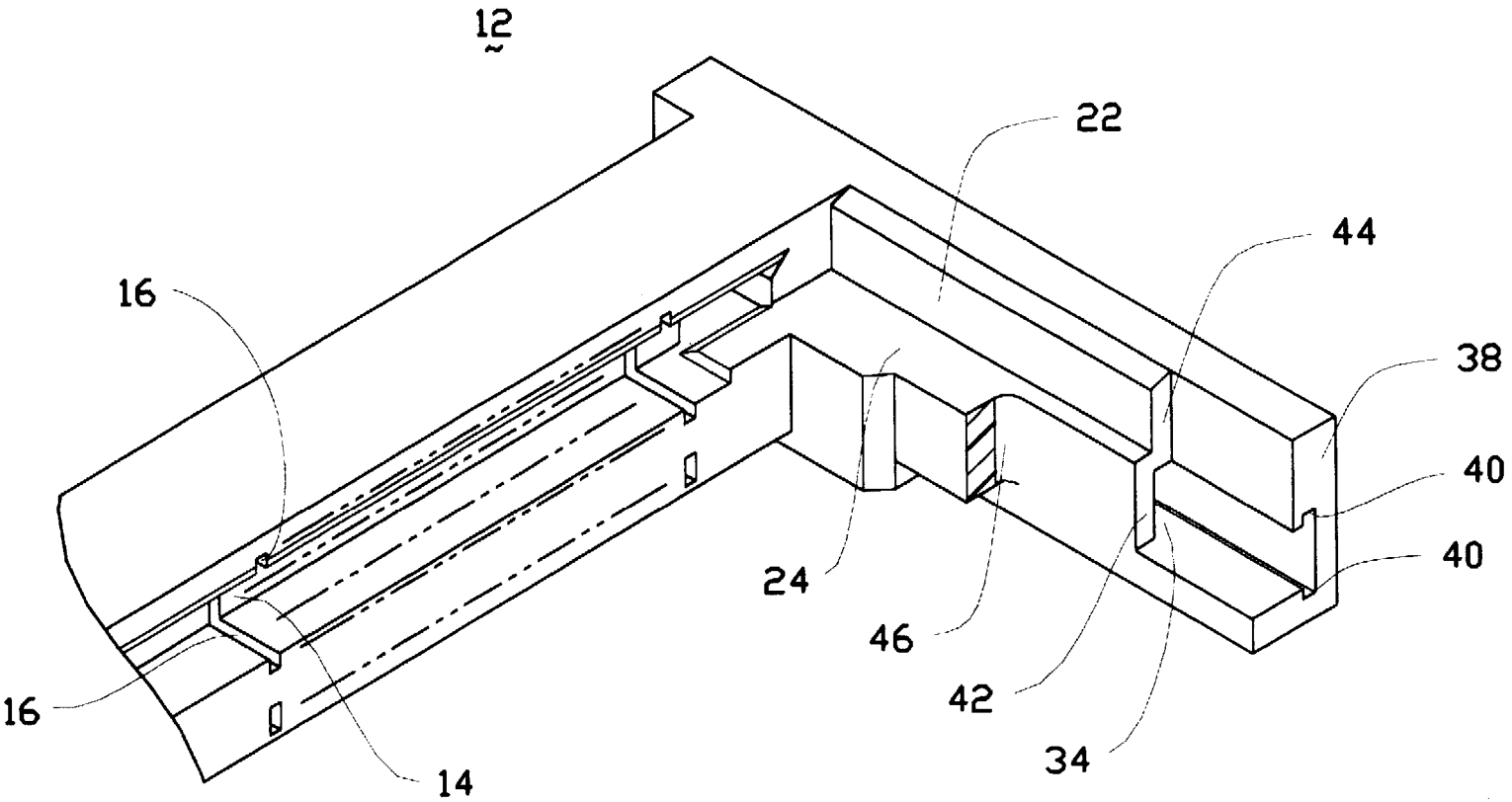
FIG. 4 is an enlarged fragmentary perspective view, from the opposite viewpoint, of the socket of FIG. 1 wherein the plastic member has been cut therefrom and the metal member has been removed therefrom to show the corresponding portion of the housing.
Figure 5:
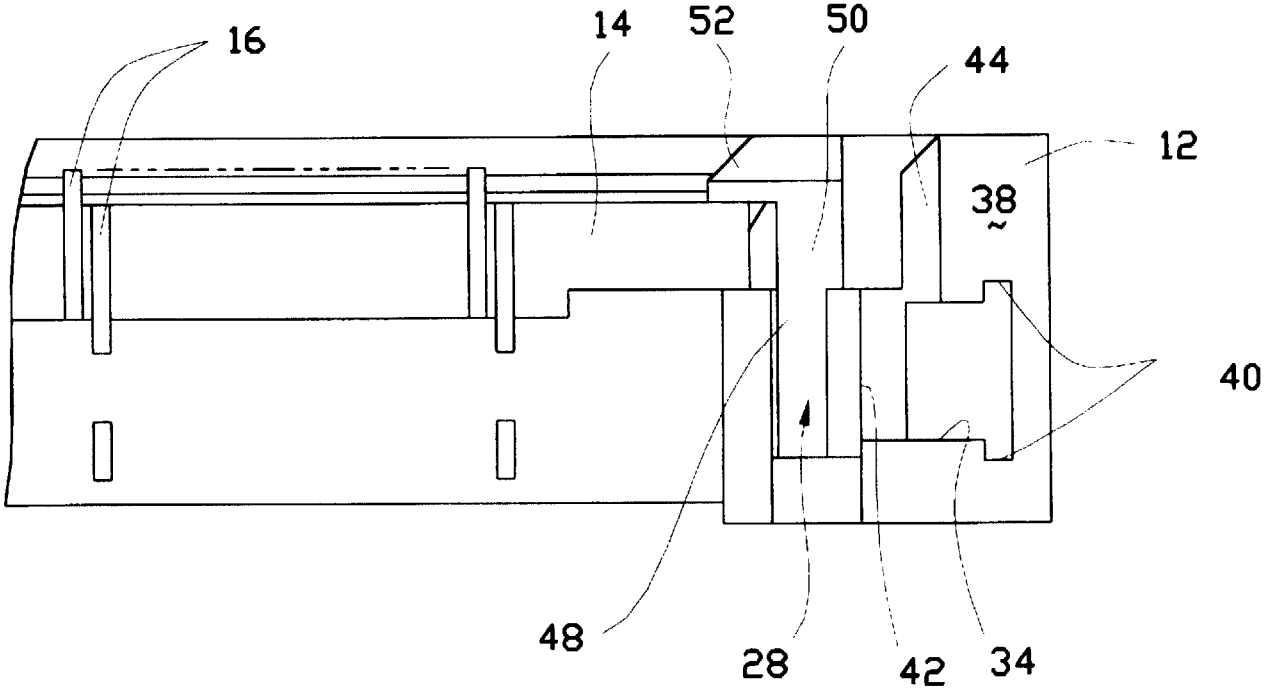
FIG. 5 is an enlarged fragmentary elevation view of the socket of FIG. 1 to show how the plastic member is positioned on the housing.
Figure 6:
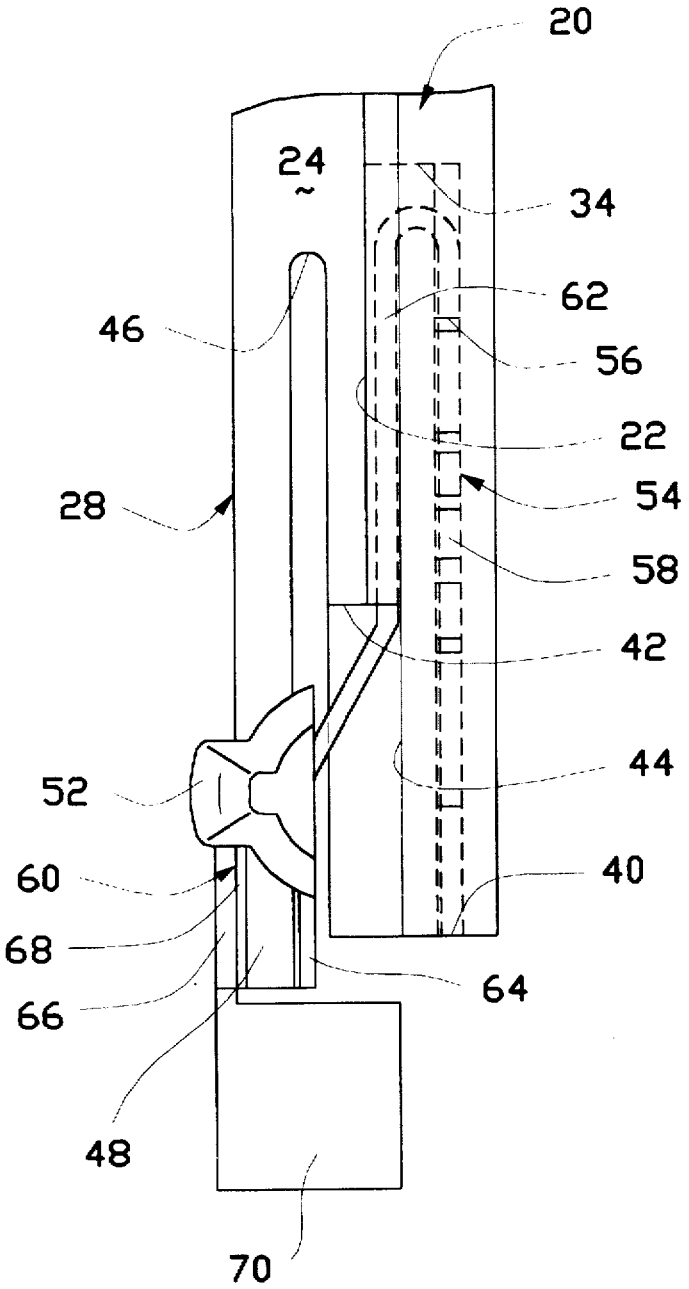
FIG. 6 is an enlarged fragmentary top view of the socket of FIG. 1 to show how the plastic member and the metal member cooperate with each other.
Figure 7:
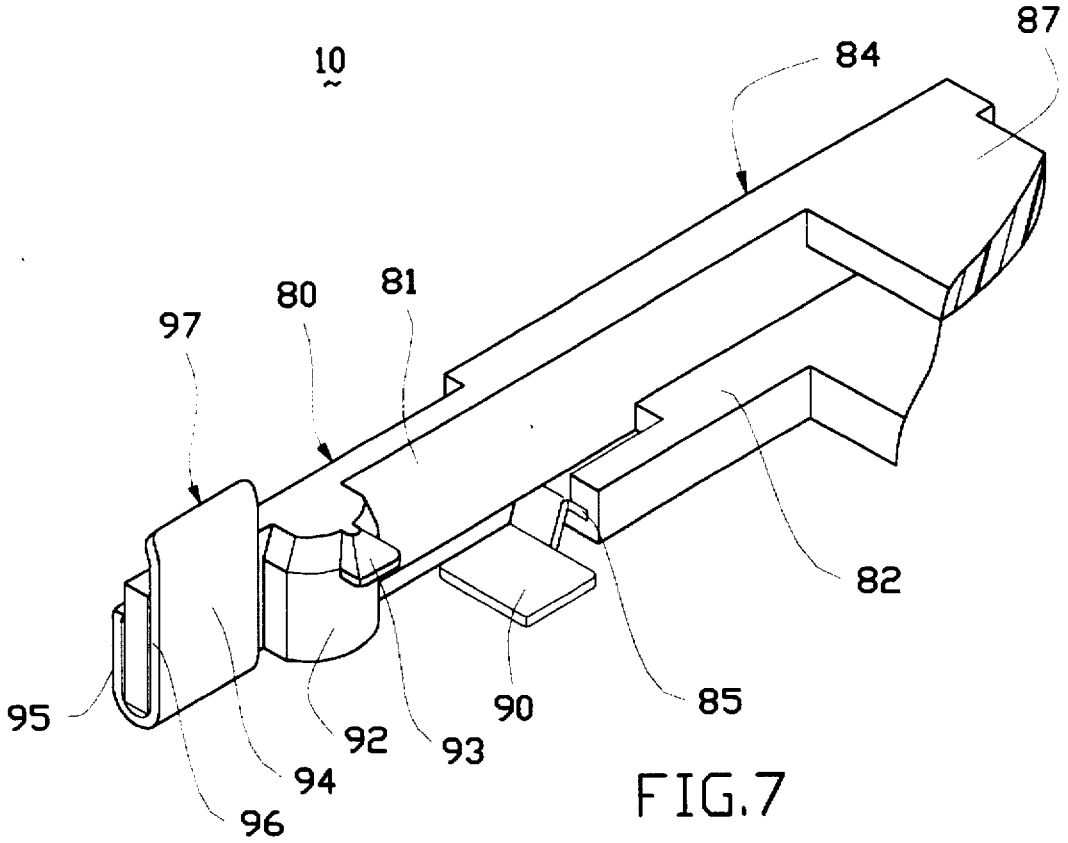
FIG. 7 is an enlarged fragmentary perspective view of another embodiment of the socket according to the invention where the plastic member is positioned beside the module.
Figure 8:
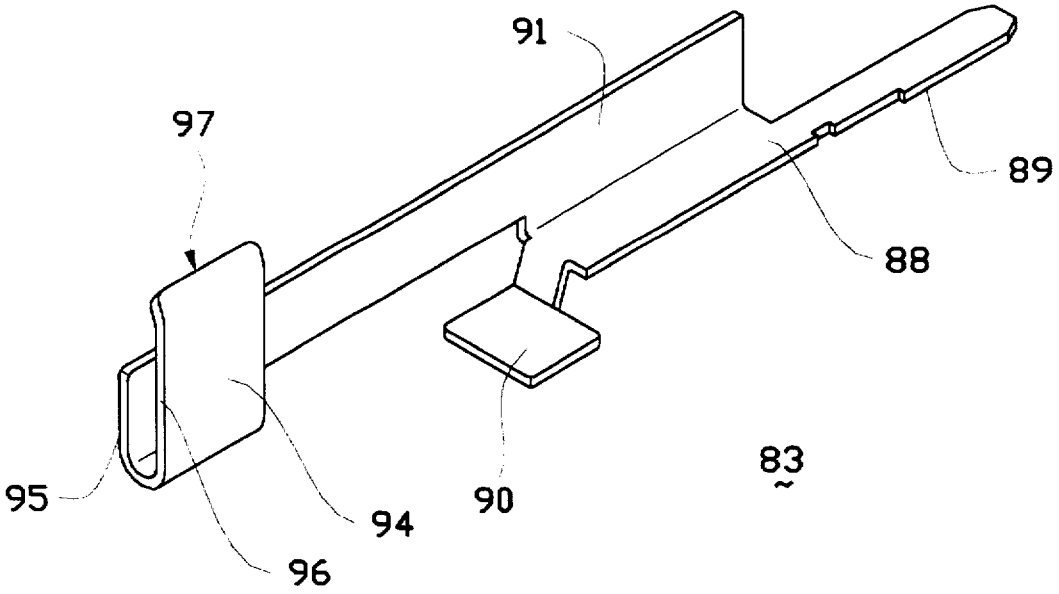
FIG. 8 is a perspective view of the metal member of FIG. 7.
Figure 9:
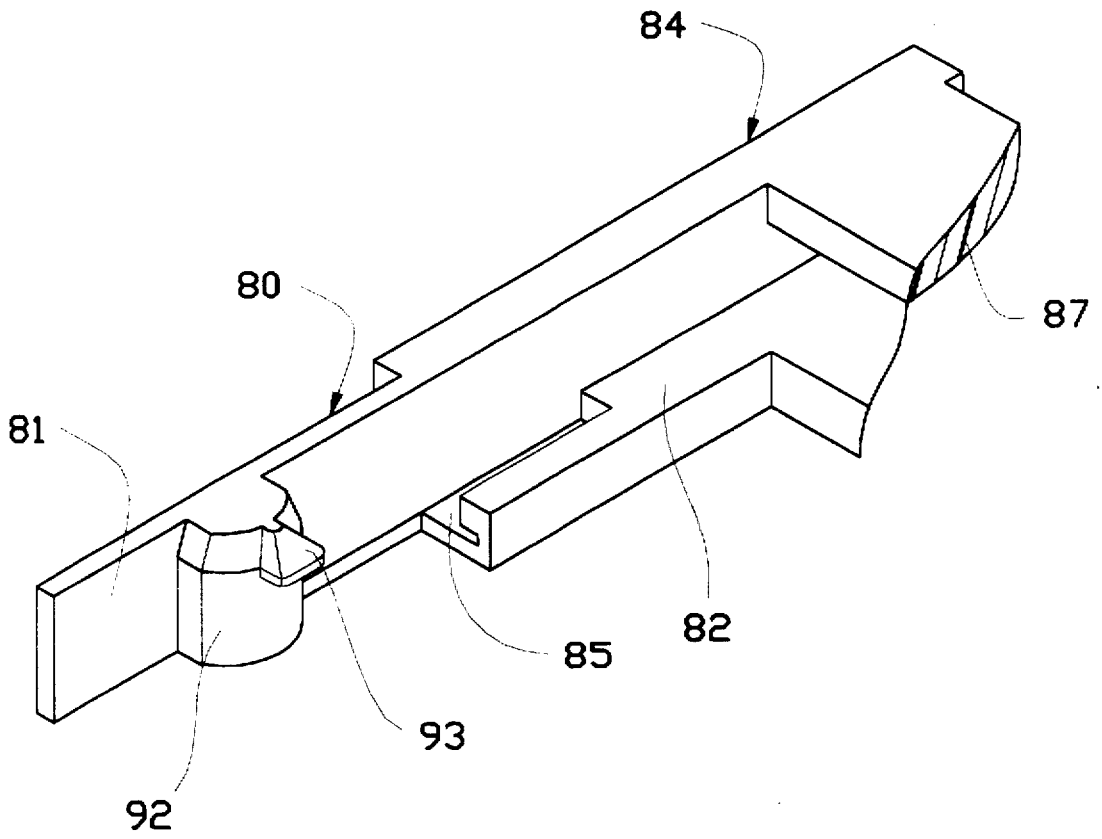
FIG. 9 is an enlarged fragmentary perspective view of the housing of the socket of FIG. 7 without the metal member therein.
Figure 10:
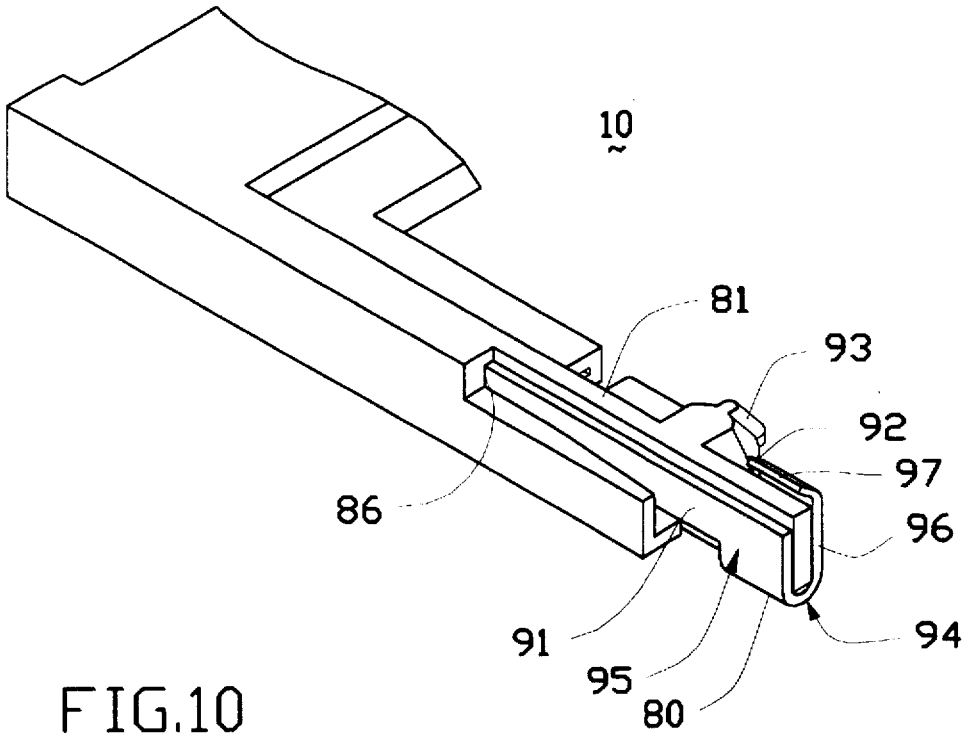
FIG. 10 is an enlarged fragmentary perspective view, from another viewpoint, of the socket of FIG. 7 to show how the metal member and the plastic member is combined.
Figure 11:
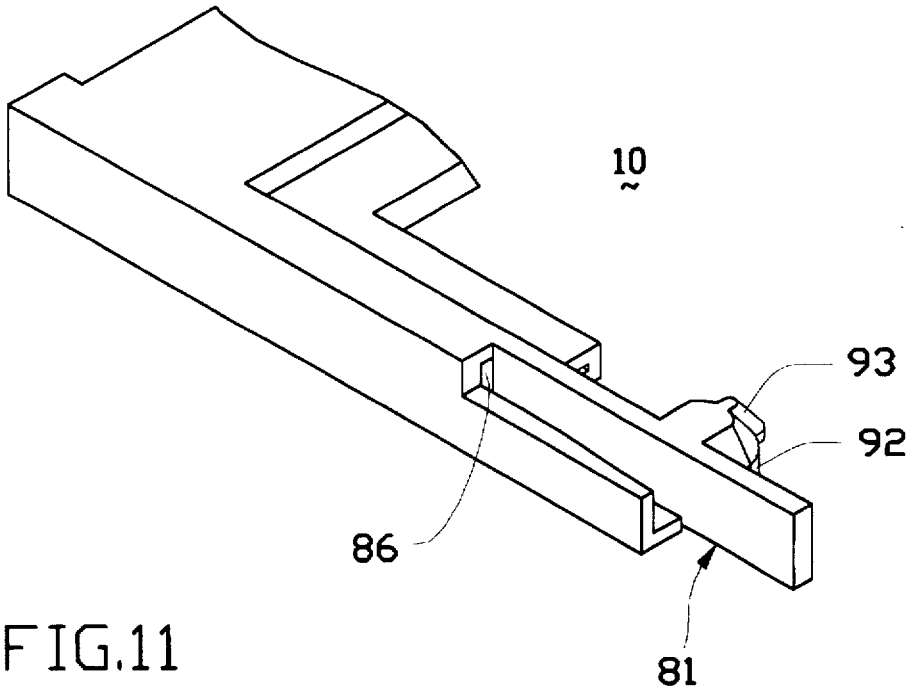
FIG. 11 is an enlarged fragmentary perspective view, from another viewpoint, of the socket of FIG. 7 to show the structure of the housing without the metal member therein.
Figure 12:
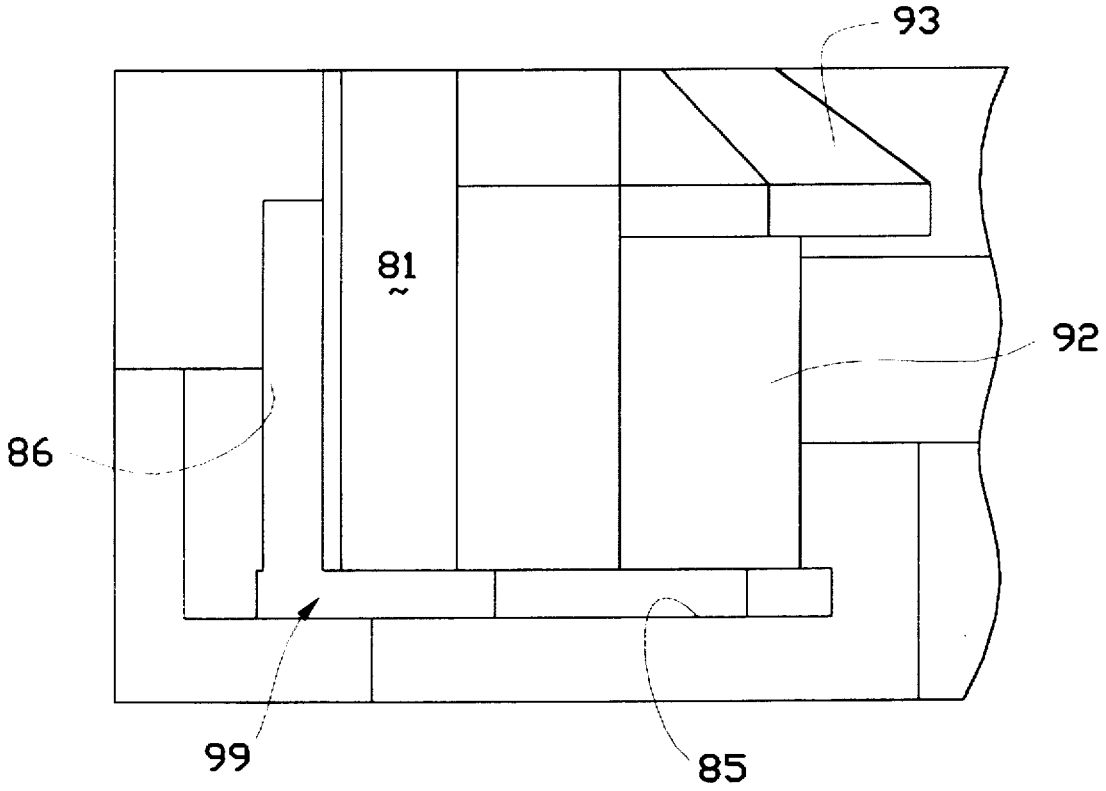
FIG. 12 is an enlarged plan view of the socket of FIG. 7 without the metal member therein to show the L-shaped

It will be noted here that for a better understanding, most of like components are designated by like reference numerals throughout the various figures in the embodiments. Attention is directed to FIGS. 1 and 2 wherein a socket 10 for receiving a module 11 (FIG. 2(A)) therein includes an insulative housing 12 with a central slot 14 (FIGS. 4 and 5) and a plurality of passageways 16 extending therethrough on two sides of the slot 14. A plurality of two different type contacts 18 (FIG. 1(A)) are received within the corresponding passageways 16, respectively. The detailed description of the contacts 18 can be referred to the co-pending application having Ser. No. 08/234,245 filed Apr. 28, 1994.(now U.S. Pat. No. 5,514,002)

A pair of platforms 20 are positioned at two opposite ends of the housing 12 each including a side abutting surface 22 and a bottom abutting surface 24 for respectively restraining the inserted module in the lengthwise direction and in the vertical direction. A pair of latching device 26 are positioned around the corresponding platform 20, respectively, and each latching device 26 includes a plastic member 28 and a metal member 30 wherein the plastic member 28 integrally extends forwardly from the platform 20 and the metal member 32 is received within activity 34 in a platform 20.

Referring to FIGS. 3–6, the cavity 34 extends inward and rearward from a front surface 38 of the platform 20, a pair of slots 40 on the upper and the lower sides thereof for engagement with the barbs 56 of the metal member 30, and a cutoff 42 formed adjacent inner side of the cavity 34 and communicative with the cavity 34 for allowing the metal member 30 to extend therethrough. An indent 44 is formed above the cutoff 42 for allowing the plastic member 28 to move thereabouts.

A space 46 is formed between the plastic member 28 and the main portion of the platform 20 for allowing the plastic member 28 to move outwardly. The plastic member 28 includes a resilient main body 48 having an upward extending post 50 adjacent the front end and an expansion head 52 on the tip of the post 50.

Therefore, when the module 11 is inserted into the socket 10, due to outward deflection of the plastic member 28, the module 11 can be rotated from the first angle position to the second horizontal position. Successively, the plastic member 28 resumes its straight manner, and the post 50 is properly surrounded in the notch 13 of the module 11 and the expansion head 52 substantially presses the regions of the module around the notch 13 (FIG. 2(A)). Under this condition, the module 11 is retained within the socket 10 in a fixed state.

The associated metal member 30 includes a U-shaped resilient main body 54 with barbs 56 formed on the first section or outer leg 58 and a clamping section 60 extending from the second section or inner leg 62. The clamping section 60 is of a U-shaped manner including the outer wall 64 and the inner wall 66 combined by a bight 68, and an operation section 70 extends from the clamping section 60 wherein the main body 54 is connected to the outer wall 64 of the clamping section 60 and the operation section 70 is connected to the inner wall 66 of the clamping section 60.

The main body 54 of the metal member 30 is received within the cavity 34 of the housing 12 wherein the barbs 56 of the outer leg 58 is received within the slots 40 for retention of the metal member 30 therein, and the inner leg 62 extends through the cutoff 42 to have the main body 48 of the plastic member 28 properly sandwiched between its outer wall 64 and the inner wall 66 of the clamping section 60, and the bight 68 is generally positioned under the plastic member 28. Under this situation, the operation section 70 is substantially positioned spaced away from and in front of the plastic member 28 for easy access from an exterior.

Understandably, when the module 11 is inserted into the socket 10, the outward deflection of the plastic member 28 certainly pushes the outer wall 64 of the clamping section 60 of the metal member 30 outward and makes the metal member 30 outward deflected. After the module 11 is rotated to the final fixed position with regard to the socket 10, the metal member 30 may be back to its original straight manner due to its own resilience and the force resulting from resiliency of the plastic member 28 which presses against the inner wall 66 of the clamping section 60. On the other hand, the resumption of the plastic member 28 results from not only its own resiliency but also the force resulting from the metal member 30, of which the outer wall 64 of the clamping section 60 presses against the plastic member 28.

In contrast, when the module 11 is intended to be withdrawn from the socket 10, a outward force is imposed on the operation section 70 of the metal member 30. Then, the inner wall 66 of the clamping section 60 pushes the plastic member 28 to move outward. The outward movement of the plastic member 28 results in the post 50 moving away from the notch 13 of the module 11, and the expansion head 52 no longer abuts against the region around the notch 13 of the module 11. Thus, the module 11 can be released from the socket 10.

One feature of the invention is to provide the metal member 30 having a U-Shaped clamping section 60 with the outer wall 64 integrally extending with the resilient main body 54 and the inner wall 66 integrally extending with the operation section 70. In comparison with the related prior arts, the configuration of the invention is of a better dynamic arrangement which assures that the forces actuated on the operation section 70 of the metal member 30 will be efficiently transferred to the plastic member 28 through the inner wall 66 of the clamping section 60. Moreover, under the structure of the invention, the combination of the plastic member 28 and the metal member 30 will not be jeopardized due to interaction resistance between the plastic member 28 and the clamping section 60 of the metal member 30. It is appreciated that because the dimension of the Mini SIMM socket is much smaller than that of the conventional SIMM, the respective metal member 30 or plastic member 28 is critically weak especially during deflection operation. Therefore, the appropriate configurations of the respective plastic member and metal member, and the right interaction positions and ways between the plastic member and metal member are surely important factors for operation of the invention. The present invention can not only achieve the desired reliable performance and convenient operation of the whole socket, but also have the plastic member and the metal member of the latching device simple enough to allow easy fabrication.

FIGS. 7–13 show another embodiment of the invention wherein different from the first embodiment of which the plastic member 28 is positioned inside the bottom abutting surface 24, the plastic member 81 of the latching device 80 is positioned outside the bottom abutting surface 82 of the platform 84. Accordingly, a first opening 85 (FIGS. 10, 11 and 12) and an adjacent second opening 86 (FIGS. 7, 9, and 12) are designedly integrally formed horizontally and vertically, respectively, in the platform 84, and thus commonly forming a whole cavity 99 with L-shaped cross-section configuration. Corresponding to the different platform 84 of the housing 87, the metal member 83 (FIG. 8) of the latching device 80 has another form different from that in the first embodiment. The metal member 83 includes a first section 88 with barbs 89 on two sides for interferentially retaining the first section 88 within the first opening 85 wherein a soldering pad 90 is positioned at the front end for reinforcement of mounting the socket 10 on the mother board (not shown). A second section 91 integrally and normally extends forwardly from one side edge of the first section 88 and is adapted to be received within the second opening 86.

Figure 13:
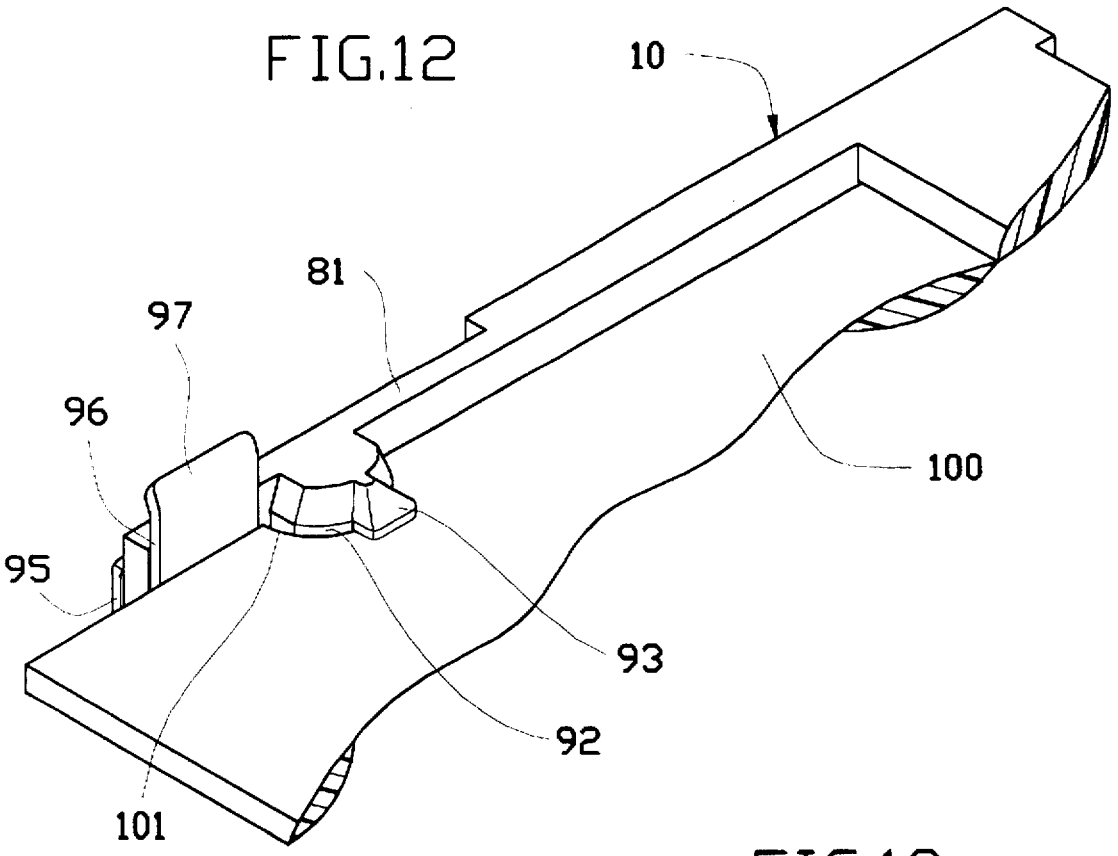
FIG. 13 is an enlarged fragmentary perspective view of the socket of FIG. 7 with an inserted module therein to show how the latch device latchably engages the module in position in the socket.

Similar to the first embodiment, the plastic member 81 has a vertical post 92 and an expansion head 93 at the tip for being received in the notch 101 of the module 100 and pressing against the region for restraining the module 100 with regard to the socket 10 in horizontal and vertical directions, respectively (FIG. 13). Naturally, the second section 91 of the metal member 83 further includes the clamping section 94 gripping the plastic member 81 wherein such clamping section 94 is of a U-Shaped form with an outer wall 95 connected to the second section 91 and an inner wall 96 connected to an operation section 97. Even though in the second embodiment the plastic member 81 is positioned beside the module 100, not under the module 100 as shown in the first embodiment, the mutual actuation and operation of the plastic member 81 and the metal member 83, and the cooperation of the whole latching device 80 including the plastic member 81 and the metal member 83, are substantially same as that in the first embodiment.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A socket including for receiving a module with notches on two side portions, comprising:

an insulative housing defining a plurality of passageways extending therethrough for receiving a corresponding number of contacts therein;

at least a platform formed at one lengthwise end of the housing; and at least a latching device being adjacent to said platform and defined with a plastic member and a metal member;

said plastic member including a resilient main body with a post integrally extending toward a longitudinal axis of the insulative housing for reception within a corresponding notch of the module and an expansion head at a tip of said post for pressing against a region of the module around said corresponding notch;

said metal member including a main body received within a cavity of the housing, and a clamping section for gripping the plastic member, being in a form of U-shape defining an inner wall and an outer wall with an intermediate bight therebetween wherein the outer wall is integrally connected with the main body and the inner wall is integrally formed with an operation section which extends far from the main body.

2. The socket as described in claim 1, wherein said platform defines a side abutting surface and a bottom abutting surface for restraint of lengthwise and vertical movements of the inserted module, respectively.

3. The socket as described in claim 1, wherein said module is sandwiched between the main body of and the head of the plastic member.

4. The socket as described in claim 1, wherein said main body of the metal member includes a first section with barbs thereon and a second section extending normally from one side edge of said first section whereby the outer wall of the clamping section is connected to said second section.

5. The socket as described in claim 4, wherein the cavity of said housing has a L-shaped cross-section configuration.

6. A socket for use with a module, comprising:

an insulative housing defining a plurality of passageways extending therethrough for receiving a corresponding number of contacts therein;

at least a platform formed at one lengthwise end of the housing; and at least a latching device being adjacent to said platform and defined with a plastic member and a metal member;

said plastic member including a resilient main body with at least an expansion head extending toward a longitudinal axis of the insulative housing for engagement with a side portion of the module;

said metal member including a main body attached to the housing, a clamping being in a form of U-shape defining an inner wall and an outer wall with an intermediate bight therebetween wherein the outer wall is integrally connected with the main body and the inner wall is integrally formed with an operation section which extends far from the main body wherein the resilient main body of the plastic member is substantially sandwiched between the inner wall and the outer wall of the clamping section of the metal member.

7. The socket as described in claim 6, wherein said main body of the metal member has a first section and second section extending normally from one side edge of said first section.

8. A latching device for use within a socket defining a housing for receiving a module therein, comprising:

a plastic member integrally extending from the housing of the socket, said plastic comprising a resilient main body with a vertically extending post having an expansion head extending toward a longitudinal axis of the insulative housing; and a metal member comprising a main body, a clamping section defined by a U-shaped configuration including an outer wall and an inner wall with an intermediate bight therebetween wherein the outer wall is integrally connected to the main body, the inner wall is integrally formed with an operation section which extends far away from said main body for easy access, and the resilient main body of the plastic member is substantially sandwiched between said outer wall and said inner wall.

9. The latching device as described in claim 8, wherein said main body of the metal member includes a first section and a second section whereby means is formed on said first section for retaining the metal member within the housing, and said outer wall of said clamping section is connected to the second section.

10. A metal member for use with a latching device of a socket defining a housing for receiving a module therein, the latching device having a plastic member, said metal member comprising:

a main body having retention means thereon for retaining the metal member to the housing;

a U-shaped clamping section including an outer wall and an inner wall with an intermediate bight therebetween for sandwiching the plastic member therein; and an operation section extending away from said main body;

wherein said main body is connected with the outer wall, and said operation section is integrally formed with the inner wall.

11. The metal member as described in claim 10, wherein said main body comprises a first section with retention barbs thereon, and a second section extending normally from the first section and integrally connected to the outer wall.

* * * * *